US006012950A

United States Patent [19]

Vanbesien

[11] Patent Number: 6,012,950

[45] Date of Patent: Jan. 11, 2000

[54] HIGH-POLARITY SHIELDED CABLE PLUG

[75] Inventor: Johan Vanbesien, Ieper, Belgium

[73] Assignee: Siemens Aktiengesellschaft, Munich, Germany

[21] Appl. No.: 08/992,299

[22] Filed: Dec. 17, 1997

[30] Foreign Application Priority Data

Dec. 17, 1996 [DE] Germany ..... 196 52 551

[51] Int. Cl.[7] ..... H01R 9/03

[52] U.S. Cl. ..... 439/610

[58] Field of Search ..... 439/607–610, 439/604, 905, 447

[56] References Cited

U.S. PATENT DOCUMENTS 5,380,224 1/1995 DiCicco ..... 439/610

FOREIGN PATENT DOCUMENTS

0421373A1 4/1991 European Pat. Off. .

*Primary Examiner*—Steven L. Stephan
*Assistant Examiner*—Eugene G. Byrd
*Attorney, Agent, or Firm*—Herbert L. Lerner; Laurence A. Greenberg

[57] ABSTRACT

A high-polarity shielded cable plug includes a substantially roof-shaped plug housing which is disposed on a connection side and has two oblique surfaces. A cable is connected to one of the oblique surfaces solely with a length of shrink-fit hose having electrically conductive adhesive on the inside. The cable plug has good cable tension relief and a simultaneous electrical connection between a cable shield of the cable and the plug housing for tight installation conditions.

8 Claims, 3 Drawing Sheets

17
8
20
19
12
1
16
21
10
11
4
13
26
37
31
6
36
35
29
5
27
3
33
32
15
25
6
30
28
2

HIGH-POLARITY SHIELDED CABLE PLUG

BACKGROUND OF THE INVENTION

Field of the Invention

The invention relates to a high-polarity shielded cable plug, including a plug housing having two conductive or conductively constructed parts, having oblique surfaces on two opposed sides and containing a plurality of contact housings of insulating material, the contact housings having a plurality of plug contacts connected to strands of a cable and connectable to contact elements of a counterpart plug connector.

In many fields, such as telecommunications, cabling occurs not on the rear side but ever more often on the front side of a piece of equipment. Moreover, more and more signal lines, which are operated at high bit rates, are needed on the front. There is accordingly a need for an electromagnetically shielded version of cable plugs, that is at least one shielding of the cable plug and of the contacts that it contains from the outside, and often a shielding of contacts or signal branches from one another as well. Moreover, according to the European telecommunications standard ETS 300 119-3 for front cabling, only very limited space is available. For instance, for a "600×600" piece of equipment, an installation space, including the front panel of the equipment or component group, of 75 mm is allowed, while for "600×300" equipment, the space provided for front cabling is only 40 mm, including the front panel.

Until now, coaxial plugs, SUB-D plugs and metric plugs have been used among others, for front cabling. However, in general those plugs do not offer the capability of connecting large quantities of signal lines to a front panel of a piece of equipment or a component group with a shielded structure and in tight installation conditions.

A cable plug of the type referred to at the outset is known from Published European Patent Application 0 421 373 A1. That cable plug has a two-part conductive plug housing, which has at least two contact housings with a multiplicity of plug contacts. The plug contacts are connected to strands of a cable and are constructed as contact pins that can be inserted into contact elements of a counterpart plug connector. On the plug-in side, the plug housing is constructed with two lateral tabs protruding perpendicularly to the plug-in direction that are offset from one another and are provided with a through bore. On the side remote from the plug-in side, the plug housing has two opposed oblique surfaces that are inclined toward one another and located between them is a flat rear end surface of the plug housing, which is parallel to the plug-in side and at which the cable introduction in the plug-in direction of the cable plug is effected. In other words, the cable is connected centrally to the plug housing, extending in the plug-in direction. The known cable plug is thus constructed in a rectilinear version with relatively high side walls and is therefore poorly suited to front cabling under tight installation conditions.

SUMMARY OF THE INVENTION

It is accordingly an object of the invention to provide a high-polarity shielded cable plug, which overcomes the hereinafore-mentioned disadvantages of the heretofore-known devices of this general type and which is suitable for front cabling under tight installation conditions.

With the foregoing and other objects in view there is provided, in accordance with the invention, in a plug assembly having a counterpart plug connector with contact elements, and a cable with strands, a cable shield covering the strands and a cable jacket covering the cable shield, a high-polarity shielded cable plug, comprising a plug housing having two conductive or conductively constructed parts, two opposed sides and oblique surfaces on the two opposed sides, the oblique surfaces disposed in a rooflike manner relative to one another and substantially forming the two opposed sides; a plurality of contact housings formed of insulating material and disposed in the plug housing, the contact housings having a multiplicity of plug contacts connected to the strands of the cable for connection to the contact elements of the counterpart plug connector; a connection neck protruding from one of the oblique surfaces and receiving an end of the cable on which the cable shield has been stripped of the cable jacket, with a portion of the stripped cable shield protruding out of the connecting neck; and a length of shrink-fit hose for mechanically and electrically connecting the cable end and the cable shield to the connection neck, the length of shrink-fit hose disposed on the cable and having an inner surface with electrically conductive adhesive, terminal portions each encompassing a respective one of the connection neck and the cable jacket and a middle portion encompassing the stripped cable shield.

In such a cable plug, an angled structural shape with a low structural height of the plug housing is achieved because of the oblique surfaces that are disposed in rooflike fashion relative to one another and because of the cable connection provided on one oblique surface. Since the cable connection is realized without rigid connecting elements, such as screw fastenings, crimped sleeves, cable clamps or the like, little installation height is needed even in the relatively tighter region of the cable connection, merely through the use of a length of a special shrink-fit hose. A cable can therefore be bent at a narrow angle, in other words extended narrowly with an allowable radius to the connection, toward and away from the connection. Since the sides of the plug housing are substantially formed by the roof-shaped oblique surfaces, this narrow cable course is possible even for closely adjacent cable plugs, because the oblique surface of a plug housing opposite a respective cable connection is free and thus does not hinder the narrow cable course even of a closely adjacent cable plug. Due to the length of shrink-fit hose which is used for the cable connection, good cable tension relief and at the same time an electrical connection between the cable shield and the plug housing is also achieved in a simple way. This provides an especially economical cable connection for shielded cable plugs.

In accordance with another feature of the invention, the middle portion of the length of shrink-fit hose forms a constriction between the cable jacket and the connection neck.

In accordance with a further feature of the invention, the plug housing is constructed with lateral tabs on two opposed sides, the tabs are offset from one another, they protrude perpendicularly to the plug-in direction and they are provided with a through bore for a screw to provide screw fastening of the cable plug to a fastening element provided in the region of the counterpart plug connector. Such a configuration of fastening tabs permits a screw fastening of especially closely adjacent cable plugs.

In accordance with an added feature of the invention, with a view to the electromagnetic shielding of the cable plug, a side of the plug housing resting on a support, such as a front panel of a component group or piece of equipment, is constructed with a framelike contact strip body for the plug contacts which is capable of being slipped onto the counterpart plug connector. In this way, the plug contacts of the cable plug are also shielded off reliably in the region of the connection to the counterpart plug connector.

In accordance with an additional feature of the invention, in cases where one or more contact housings of the cable plug are equipped with plug contacts that form different signal branches, the framelike contact strip body is provided with one recess extending in the plug-in direction and open toward the plug-in side, on each of two opposed side surfaces. In this case, a component group which, for instance, is constructed to be conductive on both sides can be guided into the recesses of the framelike contact strip body between the plug contacts of various signal branches and can then shield off these plug contacts from one another.

In accordance with yet another feature of the invention, the contact housing has individual laminations stacked on one another.

In accordance with a concomitant feature of the invention, the cable has a given diameter in the vicinity of the stripped cable shield, and the connection neck has an inside diameter adapted to the given diameter.

Other features which are considered as characteristic for the invention are set forth in the appended claims.

Although the invention is illustrated and described herein as embodied in a high-polarity shielded cable plug, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
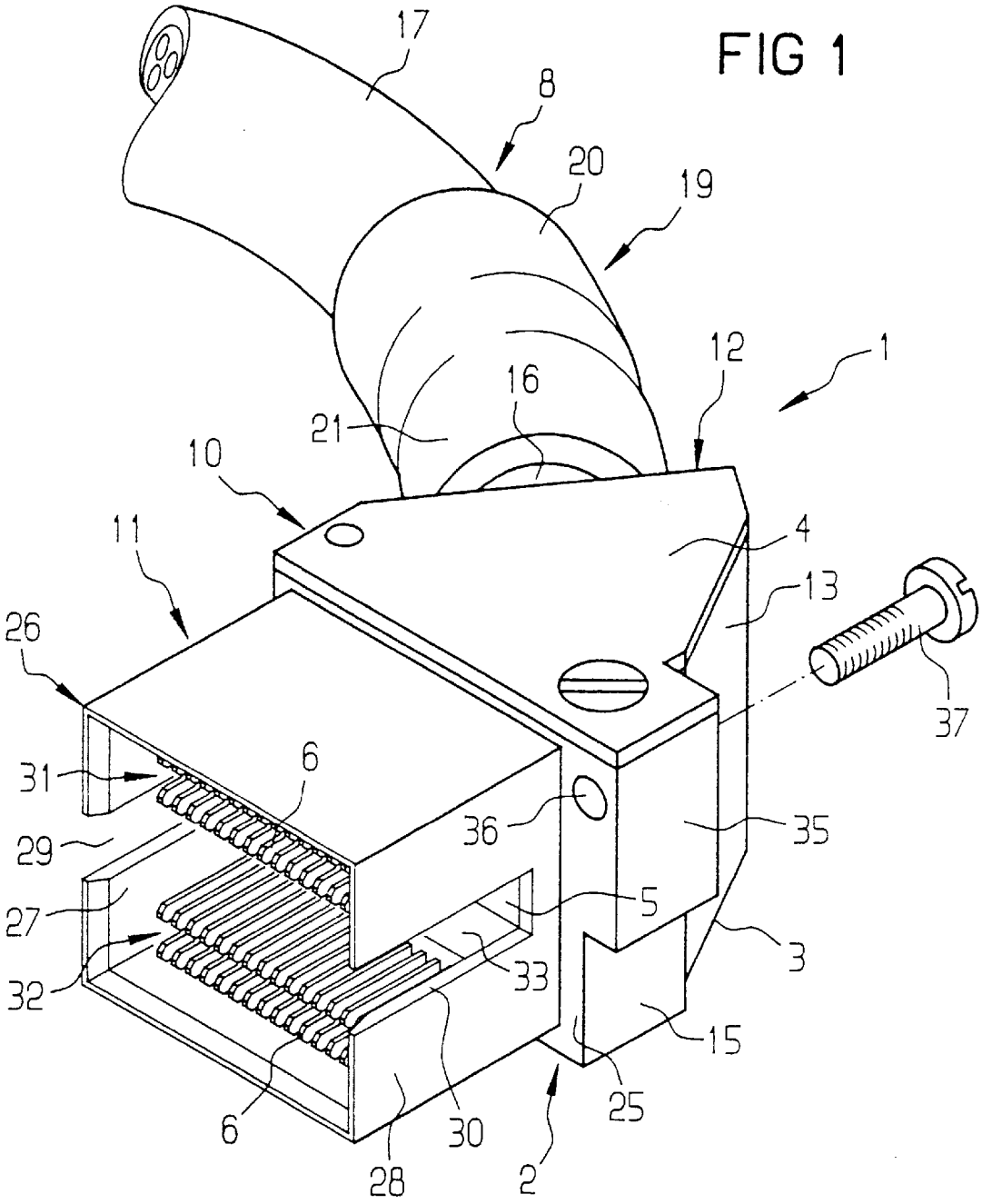
FIG. 1 is a fragmentary, diagrammatic, perspective view of a single cable plug.

Referring now to the figures of the drawings in detail and first, particularly, to FIG. 1 thereof, there is seen a cable plug 1 including a plug housing 2 which has two conductive or conductively constructed parts that are made, for instance, of metal or metallized plastic. The two parts of the plug housing 2 may be formed by half-shells or by one hollow part 3 as a base body with a cap 4 mounted thereon, as in the embodiment of FIG. 1.

Figure 2:
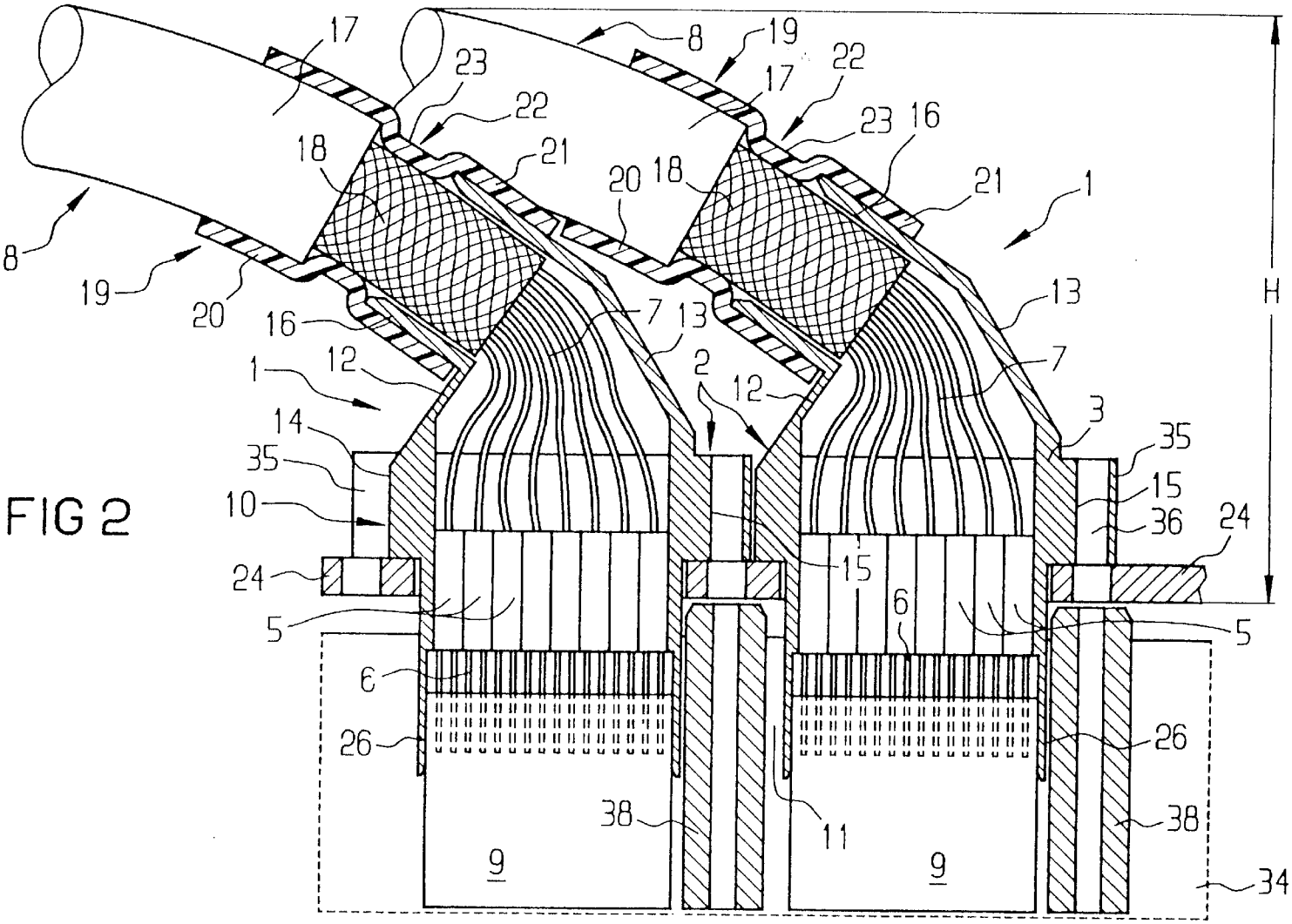
FIG. 2 is a more diagrammatic, fragmentary, sectional view of a plug connection with two cable plugs located close together and inserted into corresponding counterpart plug connectors.
Figure 3:
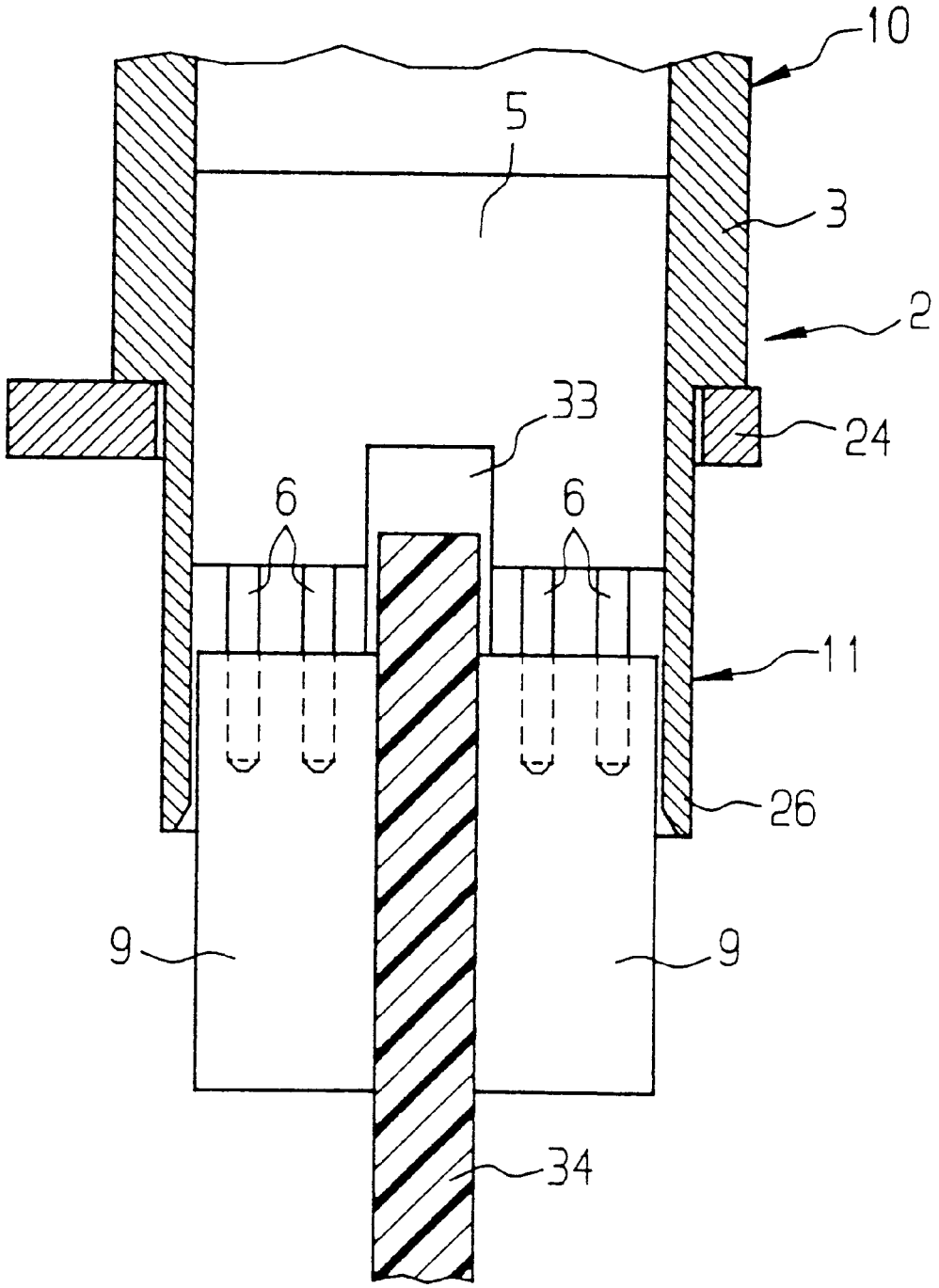
FIG. 3 is a sectional view of a cable plug of the configuration of FIG. 2, as seen from the side.

The plug housing 2 includes a plurality of contact housings 5 as is seen in FIGS. 2 and 3. The contact housings 5 are made of insulating material and in the embodiment shown in FIGS. 2 and 3 are formed, for instance, by individual lamination modules that are mounted and stacked on one another, in the plug housing 2. The contact housings 5 have many previously installed plug contacts 6, which on one hand are joined in the manner of laminations to strands 7 of a cable 8 and on the other hand form contact elements, such as knifelike or pinlike or bushlike contact elements, which can be inserted into complementary contact elements of a counterpart plug connector 9, such as a spring contact strip.

The plug housing 2 in the embodiment of FIG. 1 includes essentially two regions, namely a housing region 10 on the connection side for the connection of the cable 8 and the reception of the contact housings 5, and a housing region 11 on the plug side which is also for receiving the contact housings 5 and the plug contacts 6 and serves the purpose of plug connection to a counterpart plug connector. The connection-side housing region 10 includes a body that is formed substantially by two oblique surfaces 12 and 13 which are disposed in rooflike fashion relative to one another and which originate at short side surfaces 14 and 15 that in this case are parallel to one another, and the body is also formed of two flat sides adapted to the shape of the body. A flat side of the plug housing 2 facing toward the observer of FIG. 1 may be formed by the cap 4 which, for instance, is secured in screwable fashion to the base body.

One of the two oblique surfaces of the connection-side housing region 10, in this case the oblique surface 12, is constructed with a bushlike connection neck 16, which in this case protrudes at a right angle from the oblique surface 12 and is disposed approximately in the middle, or in the region of a "ridge of the roof" of the connection-side housing region 10. The connection neck 16 is used for introducing and connecting the multi-strand cable 8, which is stripped of a cable jacket 17 over a certain length on its end that is to be connected. The cable end is introduced far enough into the connection neck 16 to ensure that a portion of the stripped cable shield 18 protrudes out of the connection neck 16. A length 19 of shrink-fit hose which is provided as the sole connecting element for mechanically and electrically connecting the cable end or cable shield 18 to the connection neck 16 of the plug housing 2, is constructed with electrically conductive adhesive on its inside. The length of shrink-fit hose 19 is disposed on the cable end in such a way that terminal portions 20, 21 thereof respectively encompass the cable jacket 17 and the connection neck 16 and a middle portion 22 thereof encompasses the stripped cable shield 18. The length 19 of shrink-fit hose, which is shrunk onto the cable end under the influence of heat, forms a constriction 23 in the middle portion 22. As FIG. 2 clearly shows, the inside diameter of the connection neck 16 is suitably adapted to the cable diameter in the region of the stripped cable shield 18, with a view toward a reliable cable connection.

The connection-side housing region 10 of the plug housing 2 of the cable plug 1 has an underside 25 that rests on a support 24 with a framelike contact strip body 26 for the plug contacts 6 that is capable of being slipped onto the counterpart plug connector 9. In the illustrated embodiment, this contact strip body 26 has two opposed side surfaces 27, 28 which are each provided with a respective recess 29, 30 extending in the plug-in direction and being open toward the plug-in side. The recesses 29, 30, which are aligned with one another, are thus located precisely at the level of an interstice that is formed in each case between two parallel rows 31 and 32 of plug contacts 6 that in this case form two signal branches to be shielded from one another. As is shown particularly in FIG. 3, the contact housings 5 are also provided on the plug side with a recess 33 in alignment with the recesses 29, 30, so that a component group 34 which is conductively coated on both sides can be introduced into the recesses 29, 30 of the contact strip body 26 and into the recess 33 of the contact housings 5 in order to shield off the two signal branches from one another. In the embodiment shown in FIG. 3, one counterpart plug connector 9, for instance a spring contact strip, is constructed on each side of the component group 34, for instance by the SMD technique. The counterpart plug connectors 9 form a high-polarity, shielded plug connection with a cable plug 1. In a configuration as shown in FIG. 3, the high polarity is achieved by small grid spacings (up to 1 mm). If there is a need for shielding, intermediate contacts can be connected to ground. Then in that case, for example, every other gap between the plug contacts 6 will not be a signal branch but instead will be connected to ground, and the corresponding contact elements of the counterpart plug connector are then likewise ground contacts.

In order to secure a cable plug 1 to the support 24, for instance to a front panel of the component group 34, the mutually opposite short side surfaces 14 and 15 of the connection-side housing region 10 of the plug housing 2 are constructed with lateral tabs 35, which protrude perpendicularly to the plug-in direction, are offset from one another and are moreover each provided with a through bore 36 for a screw 37. This serves the purpose of screw fastening the cable plug 1 to fastening elements 38 provided in the region of the counterpart plug connector 9. These fastening elements 38, for instance, include a sleeve with a female thread, a nut, or a sheet-metal angle with a threaded nozzle. Two fastening elements 38 are each mounted on both sides of a counterpart plug connector 9 on the component group 34 for fastening one cable plug. In this way, plug housings of cable plugs can be contacted close together to the support or front panel 24 located between the tabs 35 and the fastening elements 38. The plug connection shown in FIG. 2 can be achieved by advantageously constructing the plug housing of the cable plugs and the cable connections, for close installation conditions, with a structural height H of only about 40 mm, including the support or front panel 24.

I claim:

1. In a plug assembly having a counterpart plug connector with contact elements, and a cable with strands, a cable shield covering the strands and a cable jacket covering the cable shield, a high-polarity shielded cable plug, comprising:

a plug housing having two conductive or conductively constructed parts, two opposed sides and oblique surfaces on said two opposed sides, said oblique surfaces disposed in a rooflike manner relative to one another and substantially forming said two opposed sides;

a plurality of contact housings formed of insulating material and disposed in said plug housing, said contact housings having a multiplicity of plug contacts connected to the strands of the cable for connection to the contact elements of the counterpart plug connector;

a connection neck protruding from one of said oblique surfaces and receiving an end of the cable on which the cable shield has been stripped of the cable jacket, with a portion of the stripped cable shield protruding out of said connecting neck; and a length of shrink-fit hose for mechanically and electrically connecting the cable end and the cable shield to said connection neck, said length of shrink-fit hose disposed on the cable and having an inner surface with electrically conductive adhesive, terminal portions each encompassing a respective one of said connection neck and the cable jacket and a middle portion encompassing the stripped cable shield.

2. The cable plug according to claim 1, wherein said middle portion of said length of shrink-fit hose forms a constriction between the cable jacket and said connection neck.

3. The cable plug according to claim 1, including a fastening element disposed in the vicinity of the counterpart plug connector, said plug housing being plugged onto the counterpart plug connector in a given plug-in direction, said two opposed sides of said plug housing having mutually offset lateral tabs protruding perpendicularly to said given plug-in direction, and said lateral tabs having a through bore formed therein receiving a screw for screw fastening the cable plug to the fastening element.

4. The cable plug according to claim 1, wherein said plug housing has a side resting on a support, said side having a framelike contact strip body for said plug contacts and said side to be slipped onto the counterpart plug connector.

5. The cable plug according to claim 4, wherein the support is a front panel of a component group or a piece of equipment.

6. The cable plug according to claim 4, wherein said framelike contact strip body has a plug-in side to be plugged to the counterpart plug connector in a plug-in direction, and said framelike contact strip body has two opposed side surfaces each having a recess extending therein in said plug-in direction and being open toward said plug-in side.

7. The cable plug according to claim 1, wherein said contact housing has individual laminations stacked on one another.

8. The cable plug according to claim 1, wherein the cable has a given diameter in the vicinity of the stripped cable shield, and said connection neck has an inside diameter adapted to the given diameter.

* * * * *